US010148038B2

(12) United States Patent
Cunningham et al.

(10) Patent No.: US 10,148,038 B2
(45) Date of Patent: Dec. 4, 2018

(54) LOCKOUT DEVICE FOR SECURING CABLE CONNECTOR

(71) Applicant: 3-CI Partnership, Calgary (CA)

(72) Inventors: Steven Paul Cunningham, Calgary (CA); Colin Corasiniti, Calgary (CA)

(73) Assignee: 3-CI Partnership, Calgary (CA)

( * ) Notice: Subject to any disclaimer, the term of this patent is extended or adjusted under 35 U.S.C. 154(b) by 0 days.

(21) Appl. No.: 15/927,755

(22) Filed: Mar. 21, 2018

(65) Prior Publication Data

US 2018/0309240 A1 Oct. 25, 2018

(30) Foreign Application Priority Data

Apr. 25, 2017 (CA) ..... 2965010

(51) Int. Cl.
*H01R 4/66* (2006.01)
*H01R 13/639* (2006.01)
*H01R 13/623* (2006.01)

(52) U.S. Cl.
CPC ..... *H01R 13/6397* (2013.01); *H01R 13/623* (2013.01)

(58) Field of Classification Search
CPC ..... H01R 4/64; H01R 4/643; H01R 12/57; H01R 4/646; H01H 85/202
USPC ..... 439/92, 100, 799, 777, 83, 98, 833
See application file for complete search history.

(56) References Cited

U.S. PATENT DOCUMENTS 6,840,782 B1 * 1/2005 Borden ..... H01R 4/643 439/92
8,899,998 B2 * 12/2014 Pyron ..... H01R 4/30 439/100
9,312,624 B2 4/2016 Borden et al.
9,543,719 B2 * 1/2017 Bartholomew .... H01R 13/6395
10,027,039 B1 * 7/2018 Smith ..... H01R 4/66

OTHER PUBLICATIONS

Office action mailed by CIPO dated Jul. 20, 2017 in counterpart Canadian patent application CA 2,965,010.

* cited by examiner

*Primary Examiner* — Phuong Chi T Nguyen
(74) *Attorney, Agent, or Firm* — ATMAC Patent Services Ltd.; Andrew T. MacMillan

(57) ABSTRACT

A lockout device includes a first ring portion positioned around a first side of a connector. A second ring portion is positioned around a second side of the connector. A fastener allows a user to selectively secure the ring portions thereby forming a tubular ring surrounding the connector. An inner facing protrusion extends toward a center of the tubular ring and into a gap present on the connector. The inner facing protrusion remains in the gap of the connector regardless of movement of the lockout device about the connector while the first ring portion is secured to the second ring portion. The inner facing protrusion holds the lockout device captive around the connector and the tubular ring covers a disconnection mechanism of the connector. A secondary tool is required in order to detach the first ring portion from the second ring portion for accessing the disconnection mechanism of the connector.

20 Claims, 12 Drawing Sheets

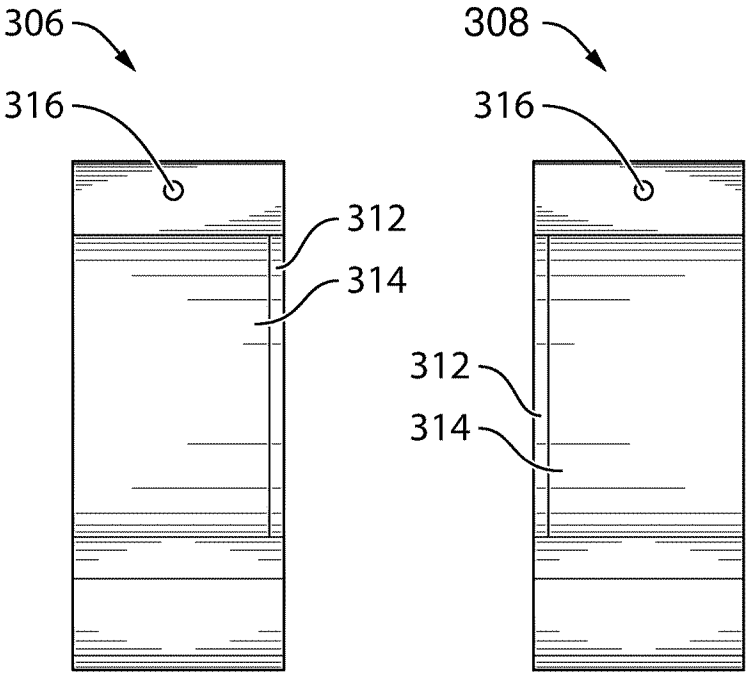
FIG. 5
FIG. 4
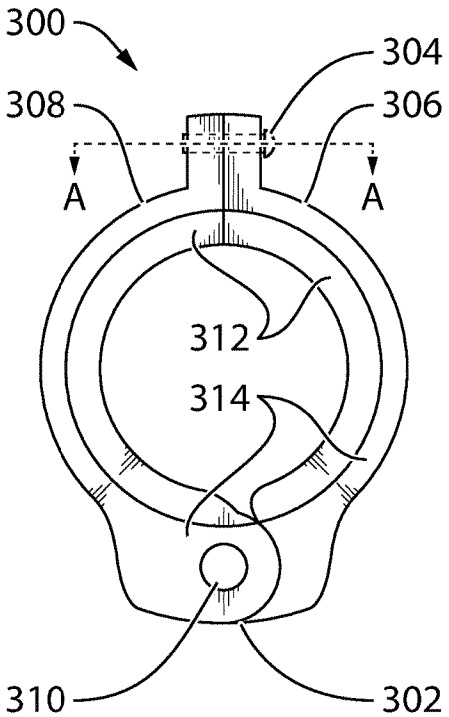
FIG. 3

LOCKOUT DEVICE FOR SECURING CABLE CONNECTOR

CROSS-REFERENCE TO RELATED APPLICATIONS

This application claims the benefit of priority of Canadian Patent Application No. 2,965,010 filed Apr. 25, 2017, which is incorporated herein by reference.

BACKGROUND OF THE INVENTION

(1) Field of the Invention

The invention pertains generally to cable connectors. More specifically, the invention relates to a lockout device requiring the use of a secondary tool in order to disconnect a cable connector.

(2) Description of the Related Art

Electrical connectors pose a safety hazard in environments having flammable gases or other ignitable substances suspended in the air. An electrical connector with contacts that are energized may cause an arc to occur upon disconnection of the connector from a panel, and the arc may ignite flammable gases in the air and cause an explosion.

Country specific electrical safety codes have been developed to classify various types of explosive gas areas and to regulate safety requirements of electrical connectors permitted within those areas. One common safety requirement is that electrical connectors used within an explosive gas area must require a secondary tool to unlock. A person should not be able to simply disconnect an electrical connector using only the person's hands. Requiring a secondary tool to disconnect the connector increases safety by making disconnection harder to perform thereby helping prevent accidental or inadvertent disconnection.

Many specialized electrical connectors have been developed that include integrated locking mechanisms that require secondary tools to unlock. However, specialized electrical connectors often include other features in addition to the secondary tool unlock capabilities and are therefore generally more expensive than typical connectors that can be freely connected and disconnected without a secondary tool.

Attempts have been made to convert a connector that does not require a secondary tool for disconnection into one that does require a secondary tool for disconnection. A typical circular connector has a threaded locking ring that is turned by hand to secure the connector a panel. On these types of connectors, a hole may be drilled through the locking ring and into the body of the connector while the connector is the connected position. A set screw may then be inserted into the hole to fix the position of the locking ring relative to the connector body. In this way, a person who desires to disconnect the connector must first utilize a secondary tool (e.g., a screwdriver) to remove the set screw before the locking ring may be turned to achieve disconnection. However, drilling a hole into a connector is both inconvenient and risky as modification may damage the structural or electrical integrity of the connector.

FIGS. 1 and 2 respectively show front and back views of a prior art connector lockout 100 previously invented by the same inventors of the present patent application. The prior art connector lockout 100 includes a square enclosure 102 that slips over a typical circular connector 104 at the point of connection where the connector 104 is attached to an angle bracket 110. A securing bolt 106 abuts tight against a locking ring 112 of the angle connector 110 and holds the prior art connector lockout 100 in position around the connector 104. Although the connector lockout 100 only encloses three sides of the joined connector 104 and angle bracket 110, the open side of the connector 104 and angle bracket 110 that are still accessible to a user are not of sufficient size for the user's fingers to generate enough torque to turn and unlock the connector's locking ring 108 or the angle connector's 110 locking ring 112. Instead, an Allen key must be utilized to remove the bolt 106 of the connector lockout 100 in order to slip the connector lockout 100 off the connector 104 and allow full access to the connector's 104 locking ring 108.

The prior art connector lockout 100 of FIG. 1 has passed inspection for use within explosive gas areas classified under the Canadian Electrical Code (CEC) as Class I, Division 2 or Zone 2 classified locations and has been sold for a over one year. However, although achieving its intended goal of requiring a secondary tool for disconnection of a connector 104, the prior art connector lockout 100 of FIG. 1 is somewhat bulky and difficult to manufacture. Improvements to the design would be beneficial.

BRIEF SUMMARY OF THE INVENTION

According to an exemplary embodiment of the invention there is disclosed a lockout device for securing a connector. The lockout device includes a first ring portion for positioning around a first side of the connector, and a second ring portion for positioning around a second side of the connector. The lockout device further includes a fastener allowing a user to selectively secure the first ring portion to the second ring portion thereby forming a tubular ring surrounding the connector. An inner facing protrusion on at least one of the first ring portion and the second ring portion extends toward a center line of the tubular ring and into a gap present on the connector. The inner facing protrusion is of sufficient length such that at least a portion of the inner facing protrusion remains in the gap of the connector regardless of movement of the lockout device about the connector while the first ring portion is secured to the second ring portion. The inner facing protrusion thereby holds the lockout device captive around the connector such that the connector cannot be slid out of the tubular ring while the first ring portion is secured to the second ring portion. The tubular ring covers a disconnection mechanism of the connector such that the disconnection mechanism of the connector is inaccessible to the user while the lockout device is held captive on the connector. The fastener requires the user to utilize a secondary tool in order to detach the first ring portion from the second ring portion for accessing the disconnection mechanism of the connector.

According to an exemplary embodiment of the invention there is disclosed a method of securing a connector. The method includes positioning a first ring portion around a first side of the connector, positioning a second ring portion around a second side of the connector, and utilizing a fastener to selectively secure the first ring portion to the second ring portion thereby forming a lockout device with a tubular ring shape surrounding the connector. The method further includes ensuring an inner facing protrusion on at least one of the first ring portion and the second ring portion extends toward a center line of the tubular ring and into a gap present on the connector. The inner facing protrusion is of sufficient length such that at least a portion of the inner facing protrusion remains in the gap of the connector regardless of movement of the lockout device about the connector while the first ring portion is secured to the second ring portion. The inner facing protrusion thereby holds the lockout device captive around the connector such that the connector cannot be slid out of the tubular ring while the first ring portion is secured to the second ring portion. The tubular ring covers a disconnection mechanism of the connector such that the disconnection mechanism of the connector is inaccessible to a user while the lockout device is held captive on the connector. The fastener requires the user to utilize a secondary tool in order to detach the first ring portion from the second ring portion for accessing the disconnection mechanism of the connector.

These and other advantages and embodiments of the present invention will no doubt become apparent to those of ordinary skill in the art after reading the following detailed description of preferred embodiments illustrated in the various figures and drawings.

BRIEF DESCRIPTION OF THE DRAWINGS

The invention will be described in greater detail with reference to the accompanying drawings which represent preferred embodiments thereof:

FIG. 3 illustrates a top view assembly diagram of a circular connector lockout device with hinge assembly and set screw according to an exemplary embodiment of the present invention.

FIG. 4 illustrates a side view assembly diagram of the first ring portion of FIG. 3 shown looking toward its concave "C" shaped area.

FIG. 5 illustrates a side view assembly diagram of the second ring portion of FIG. 3 shown looking toward its concave "C" shaped area.

DETAILED DESCRIPTION

Figure 1:
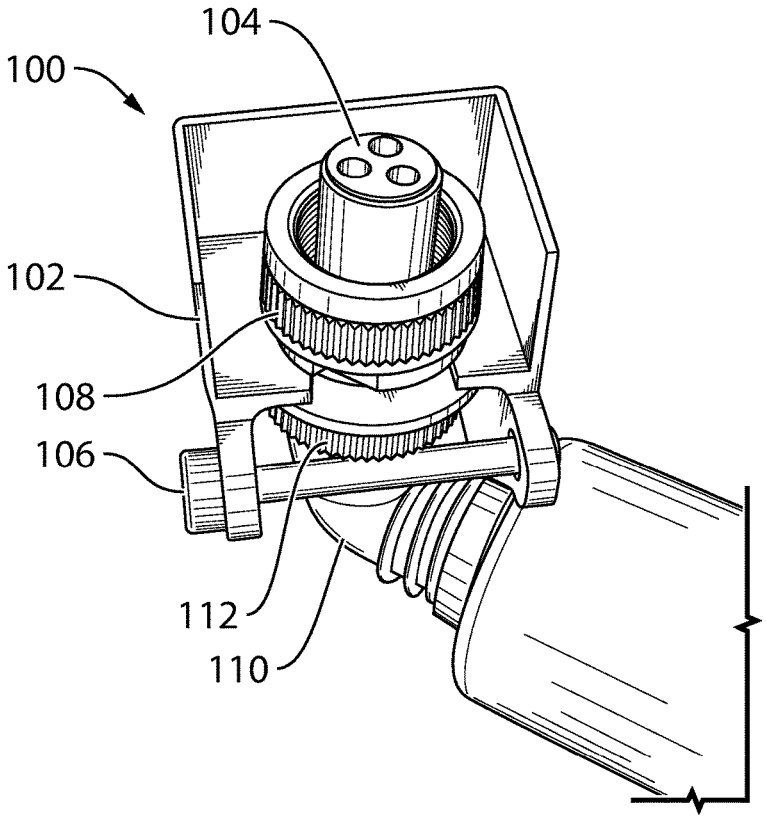
PRIOR ART FIG. 1
FIG. 1 shows a front view of a prior art connector lockout previously invented by the inventors of the present patent application.
Figure 2:
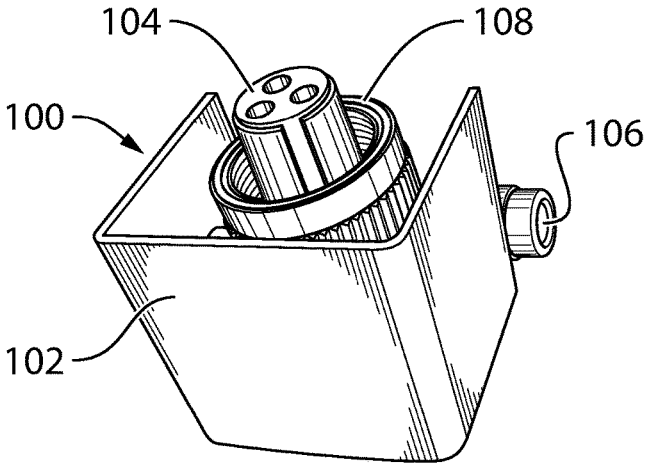
PRIOR ART FIG. 2
FIG. 2 shows a back view of the prior art connector lockout of FIG. 1.

FIG. 3 illustrates a top view assembly diagram of a circular connector lockout device 300 with hinge assembly 302 and set screw 304 according to an exemplary embodiment of the present invention. The lockout device 300 includes a first ring portion 306 and a second ring portion 308 both generally formed by "C" shaped parts made of aluminum. The first ring portion 306 and the second ring portion 308 are secured to one another by the user of the hinge assembly 302 with integrated hinge pin 310 shown at the bottom area of FIG. 3 and the user adjustable set screw 304 shown at the top area of FIG. 3. Together, the first ring portion 306 and the second ring portion 308 form a tubular ring that can be utilized to surround the perimeter of a circular connector.

An inner facing protrusion is formed in this example by a circular ridge that acts as a locator ring 312 for holding the lockout device 300 captive on the connector while the first ring portion 306 is secured to the second ring portion 308. As illustrated in FIG. 3, a circular ridge on both the first ring portion 306 and the second ring portion 308 together forms the circular locator ring 312.

FIG. 4 illustrates a side view assembly diagram of the first ring portion 306 of FIG. 3 shown looking toward its concave "C" shaped area. Likewise, FIG. 5 illustrates a side view assembly diagram of the second ring portion 308 of FIG. 3 shown looking toward its concave "C" shaped area. As illustrated, the locator ring 312 is flush with opposite side edges of the first and second ring portions 306, 308 when viewed looking toward their concave "C" shaped portions. In this way, when the first ring portion 306 and second ring portion 308 are attached together to form the tubular ring illustrated in FIG. 3, the locator ring 312 on each ring portion 306, 308 forms a circular ridge that extends inward into a center line of the tubular ring. As is explained in further detail below, the locator ring 312 is utilized to position the lockout device 300 on a connector.

The remaining portion of the tubular ring is referred to herein as a captive ring 314 and is intended to cover a disconnection mechanism of the connector to which the lockout device 300 is secured. For instance, the captive ring 314 may surround a locking ring of a connector and thereby render the locking ring of the connector inaccessible to the user while the lockout device 300 is held captive on the connector by the locator ring 312.

Figure 6:
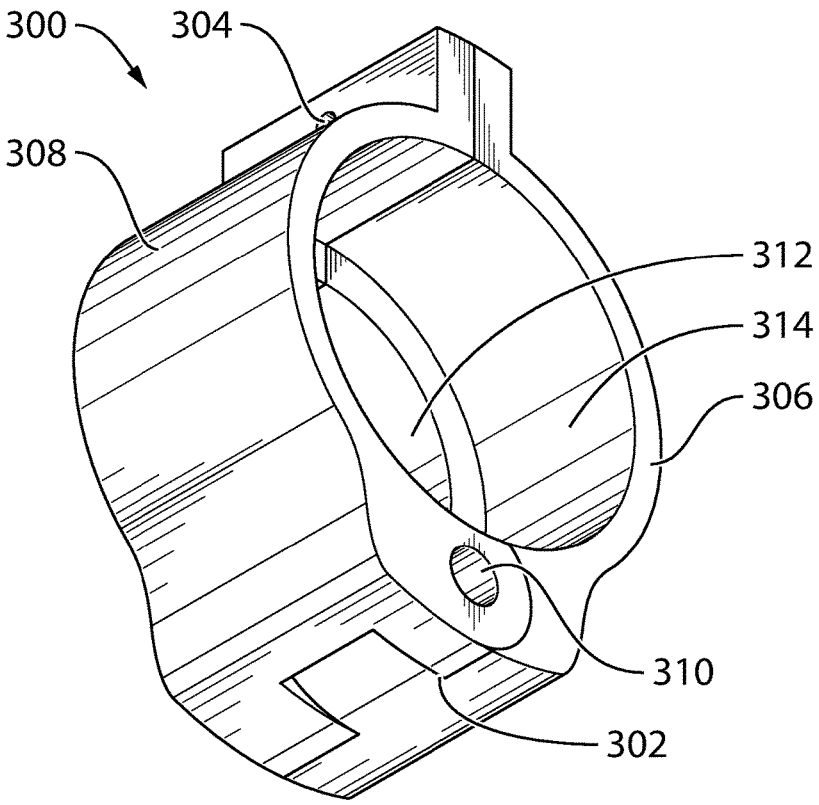
FIG. 6 illustrates an isometric view assembly diagram of the lockout device of FIG. 3.

FIG. 6 illustrates an isometric view assembly diagram of the lockout device 300 of FIG. 3. The inner facing locator ring 312 can be seen within the tubular ring formed by the first ring portion 306 and the second ring portion 308. The ring portions 306, 308 are held together at the bottom with a hinge assembly 302 having an associated hinge pin 310 which may be installed on a permanent basis during manufacture. The first and second ring portions 306, 308 are rotatable with respect to one another around the hinge ping 310. To secure the hinged first and second ring portions 306, 308 to one another, threaded screw holes 316 are provided at the top of both the first and second ring portions 306, 308. The set screw 304 is fastened within the holes 316.

Figure 7:
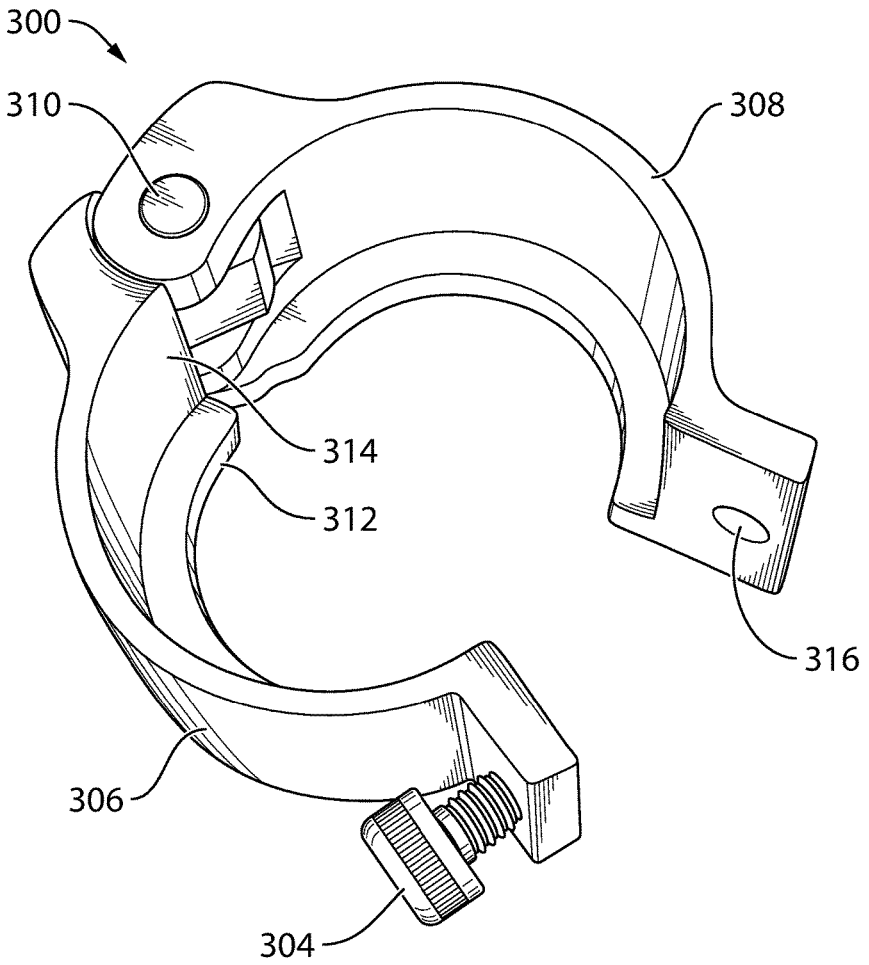
FIG. 7 shows a first side view of a working prototype of the lockout device of FIG. 3 built by the inventors according to an exemplary embodiment.

FIG. 7 shows a first side view of a working prototype of the lockout device 300 of FIG. 3 built by the inventors according to an exemplary embodiment. In FIG. 7, the lockout device 300 is orientated such that the locator ring 312 is lying on the table surface. The set screw 304 is partially unscrewed such that the first ring portion 306 is disconnected from the second ring portion 308 at one end. The lockout device 300 is shown in an opened position for attachment and detachment to/from a connector.

Figure 8:
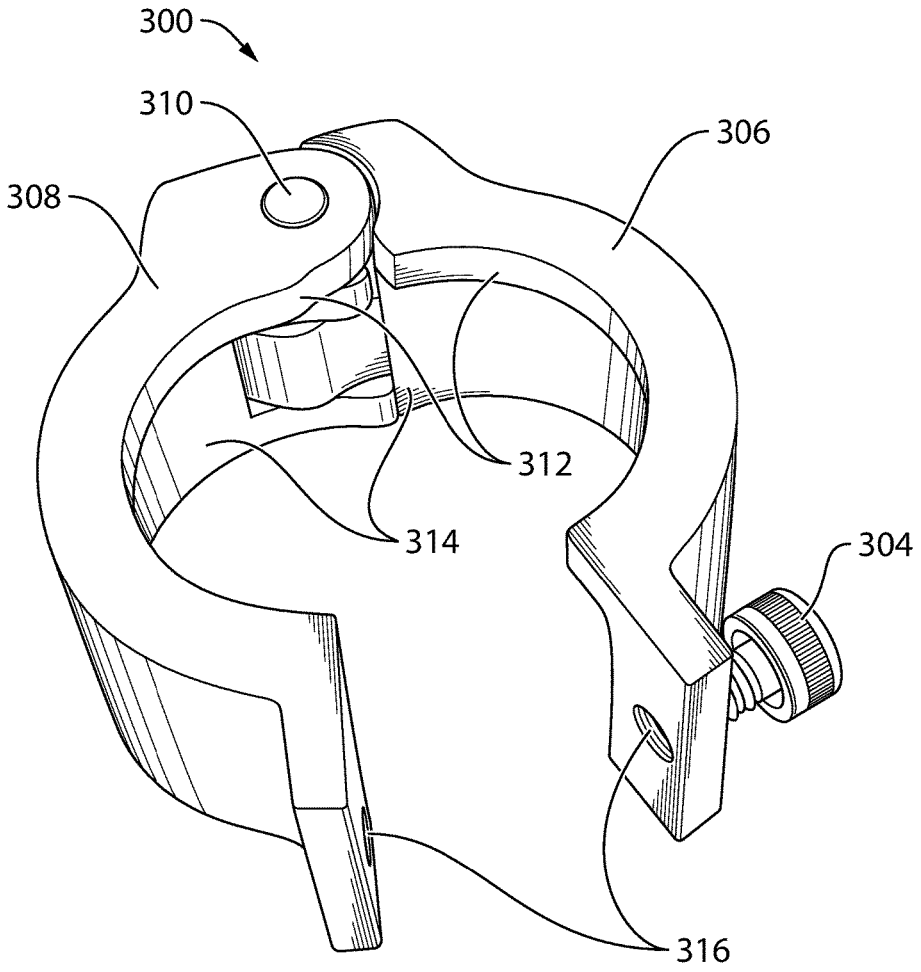
FIG. 8 shows a second side view of the working prototype of the lockout device of FIG. 7.

FIG. 8 shows a second side view of the lockout device 300 of FIG. 7. In this picture, the lockout device 300 is orientated such that the locator ring 312 is on the side facing the camera. As illustrated, the locator ring 312 in this embodiment is flush with the side edges of the first and second ring portions 306, 308.

Figure 9:
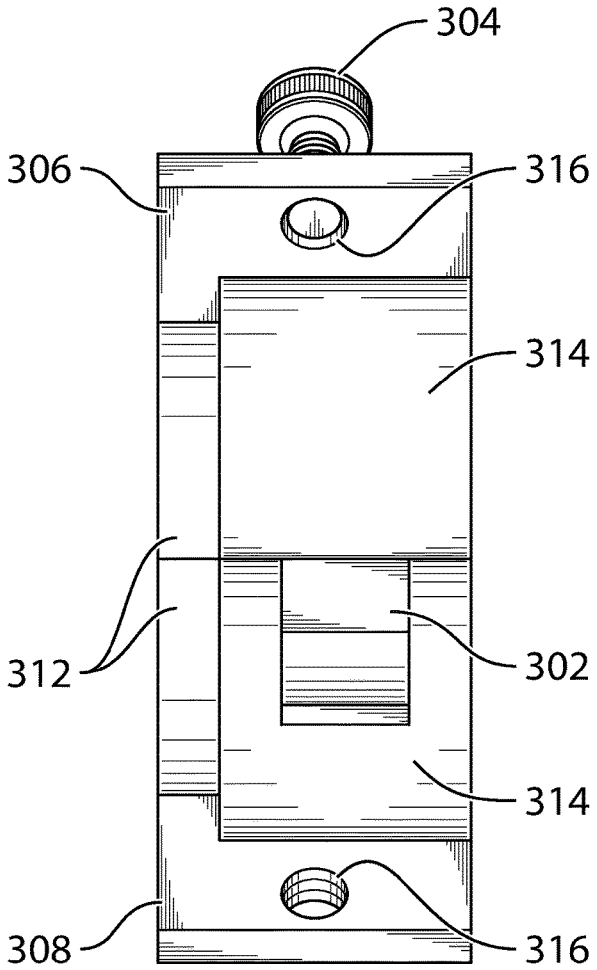
FIG. 9 shows an end view of the working prototype of the lockout device of FIG. 7 as seen looking in to the open area between the first ring portion and the second ring portion rotated in the open configuration.

FIG. 9 shows an end view of the lockout device 300 of FIG. 7 as seen looking in to the open area between the first ring portion 306 and the second ring portion 308 as their ends with the set screw holes 316 are rotated away from one another. The inner protruding locator ring 312 can be seen on the left side of this view and the rest of the tubular ring to the right of the locator ring 312 forms the captive ring 314 for enclosing the locking mechanism of a connector.

Figure 12:
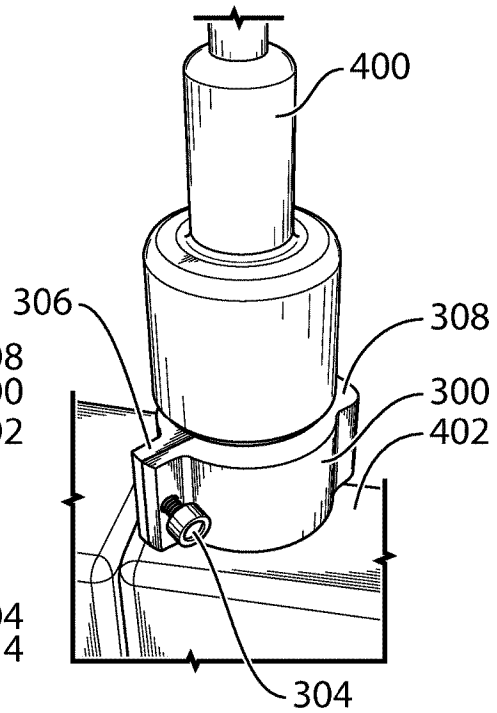
FIG. 12 illustrates the working prototype of the lockout device of FIG. 7 in the closed configuration around the connector after installation.
Figure 11:
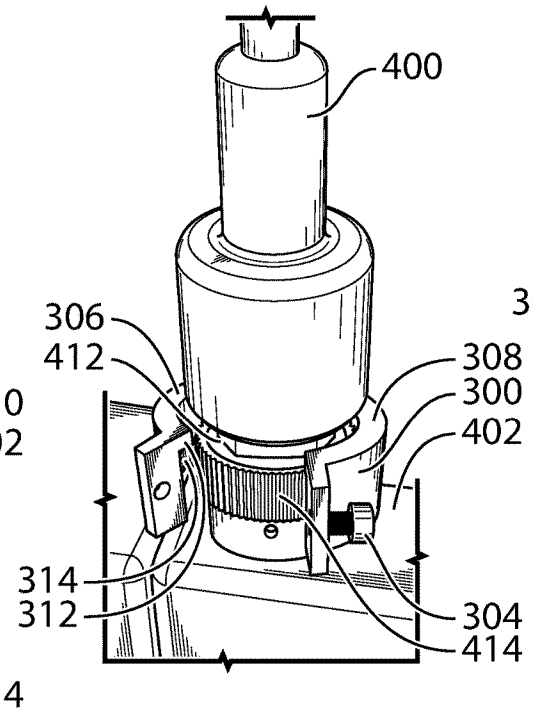
FIG. 11 illustrates working prototype of the lockout device of FIG. 7 in the open configuration around the cable connector during installation.
Figure 10:
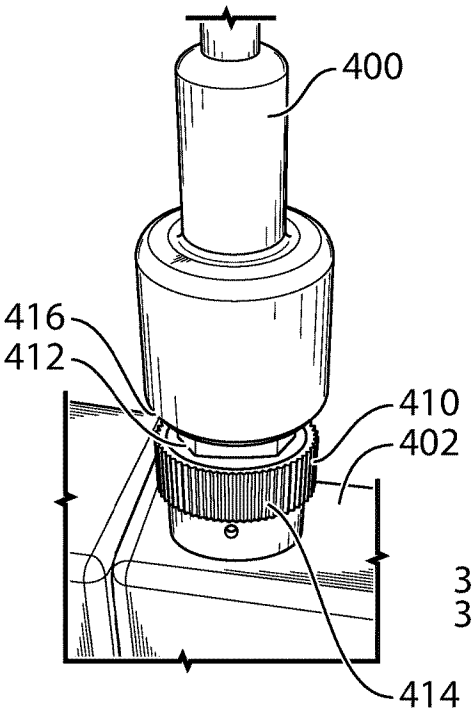
PRIOR ART FIG. 10
FIG. 10 illustrates a typical circular cable connector attached to an associated panel connector according to the prior art.

FIGS. 10 to 12 illustrated a method of utilizing the lockout device of FIG. 4 to secure a connector. The steps of the below method are not restricted to the exact order described, and, in other configurations, described steps may be omitted or other intermediate steps added.

To begin the securing process, a cable 400 is attached to a connector on a panel 402 in the usual manner by a user. FIG. 10 illustrates a typical circular cable connector 410 attached to an associated panel 402 connector according to the prior art. In this example, the connectors are MS style circular connectors that have no native requirement to utilize a secondary tool for connection or disconnection. Although MS style connectors are illustrated, it is to be understand that the lockout device 300 and method of use described herein may also be utilized in conjunction with other types of circular electrical connectors including but not limited to MS-style connectors, PS-style connectors, 26482 series connectors, 5015 series connectors, etc.

After the cable 400 is connected to the panel 402 using standard connectors 410 in the usual manner, a lockout device 300 for this connector type and size are selected. The set screw 304 of the lockout device 300 is unscrewed in order to spread open the "C" shaped first and second ring portions 306, 308 and wrap around the connector.

FIG. 11 illustrates the lockout device 300 in the open configuration wrapped around the cable connector 410. During this step, the user should orientate the lockout device 300 such that the inner protruding locator ring 312 extends into the gap 412 formed between the locking ring 414 of the cable connector 410 and the connector backshell 416. When orientated in the correct manner with the locator ring 312 within the gap 412 between the locking ring 414 and the connector backshell 416, the remaining captive ring 314 of the lockout device 300 will extend downward and completely cover the locking ring 414 of the connector 410.

As illustrated in FIG. 12, after the lockout device 300 is wrapped around the connector 410 in the correct orientation and with the locator ring 312 extending into the gap 412 of the connector 410, the lockout device 300 is closed by rotating the first and second ring portions 306, 308 toward one another and securing the set screw 304. While in the closed position, the first and second ring portions 306, 308 are secured to one another by both the hinge 302 at one end and the set screw 304 at the other end. The locator ring 312 of the lockout device 300 is stuck within the gap 412 between the locking ring 414 of the cable connector 410 and the connector backshell 416. In this way, even though the lockout device 300 may be wiggled and rotated around the connector 410 by a user, it is not possible to slide the closed lockout device 300 upwards or downwards. While the first ring portion 306 is secured to the second ring portion 308, the inner facing locator ring 312 is of sufficient length such that at least a portion of it remains in the gap 412 of the connector 410 regardless of movement of the lockout device 300 about the connector. When attempting to slide the lockout device 300 upwards, the locator ring 312 is blocked from moving by the backshell 416. Likewise, when attempting to slide the lockout device 300 downwards, the locator ring 312 is blocked from moving by the top edge of the connector's locking ring 414.

The lockout device 300 in the closed configuration as illustrated in FIG. 12 thereby prevents the user from accessing the locking ring 414 of the connector without first removing the lockout device 300. In order for a user to disconnect the cable 400 from the panel 402, the user will need to utilize a secondary tool such as a screwdriver or Allen key in order to unscrew the set screw 304 and remove the lockout device 300 from around the connector 410.

Figure 13:
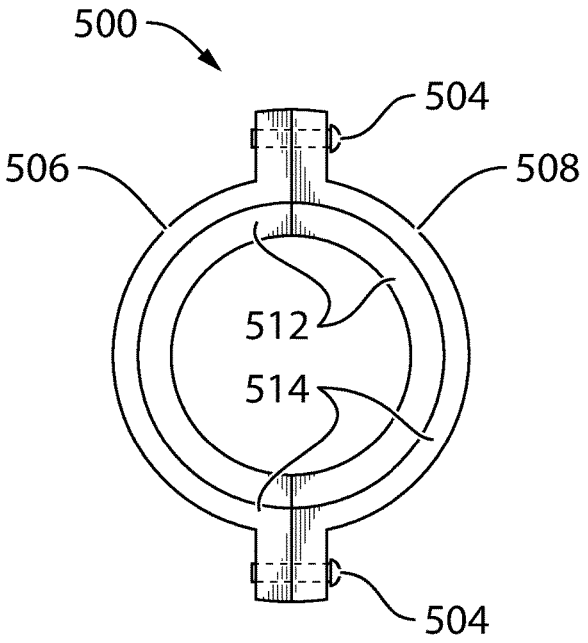
FIG. 13 illustrates a top view assembly diagram of a circular connector lockout device with dual set screws according to an exemplary embodiment of the present invention.

FIG. 13 illustrates a top view assembly diagram of a circular connector lockout device 500 with dual set screws 504 according to an exemplary embodiment of the present invention. In this embodiment, the lockout device 500 is again implemented by a first ring portion 506 and a second ring portion 508; however, unlike in the previous examples, the lockout device 500 of FIG. 12 is not hinged. Instead, the first and second portions 506, 508 are secured together by the use of two set screws 504—one at the top and one at the bottom. The remaining portions of the design including an inner protruding locator ring 512 and captive ring 514 are the same as in the previous examples. The embodiment of FIG. 12 may be beneficial in some applications by simplifying the manufacturing process. Both the first and second ring portions 506, 508 in this embodiment are identical and therefore the number of unique pieces of the lockout device 500 is reduced.

Figure 14:
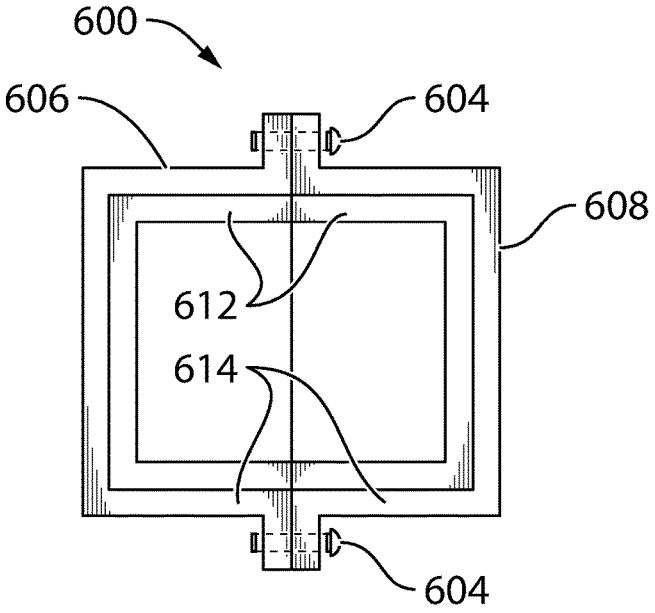
FIG. 14 illustrates a top view assembly diagram of a square connector lockout device with dual set screws according to an exemplary embodiment of the present invention.

In addition to securing circular cable connectors as in the previous examples, other connector shapes may also be secured in a similar manner. For example, FIG. 14 illustrates a top view assembly diagram of a square connector lockout device 600 with dual set screws 604 according to an exemplary embodiment of the present invention. This lockout device design is for use with square electrical connectors. As illustrated in FIG. 14, the locking device of FIG. 14 is formed by two rectangular shaped ring portions 606, 608. Each of the rectangular shaped ring portions 606, 608 includes a locator ring 612 formed by an inner facing ridge, and the ring portions 606, 608 are secured together by dual set screws 604 after being placed around a connector to be locked. Similar to the previous example, the captive ring 614 acts as a shield that covers the locking ring or other disengagement mechanism of the connector such that the connector's disengagement mechanism is inaccessible without first removing the lockout device 600. In other embodiments, one of the set screws 604 of FIG. 14 may also be replaced with any suitable hinge system similar to as shown in some of the above circular lockout device 300 examples. Similar lockout devices 300, 500, 600 of any desired shape such as suitable for rectangular and triangular connectors may be provided in other embodiments.

The above-provided usage example focused on securing an already-connected connector by preventing disconnection from occurring without the use of a secondary tool. However, the lockout devices 300, 500, 600 disclosed herein may also be utilized in other applications to secure an already-disconnected connector to prevent it from being connected without the use of a secondary tool. Preventing accidental connection may also be beneficial for safety reasons since the act of connecting an energized electrical connector to a panel may also cause an arc at the time of connection.

Figure 15:
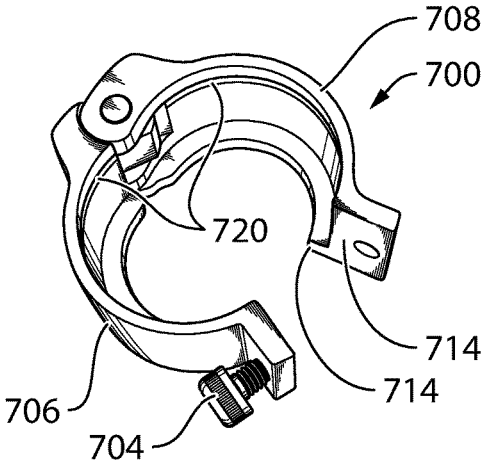
FIG. 15 shows a side view of a lockout device with a grove capable of accepting a filler cap according to an exemplary embodiment.

FIG. 15 shows a side view of a lockout device 700 with a grove 720 capable of accepting a filler cap 722 according to an exemplary embodiment. The lockout device of FIG. 15 is generally the same as that illustrated in FIGS. 3-9 with the addition of an etched-out grove 720 running around the inner edge of the captive ring 714. The grove 720 is located toward the edge opposite the captive ring 712 and is utilized to hold the position of a filler cap 722 shown in FIG. 16. The thickness of the grove 720 is sufficient to accept the filler cap 722. Likewise, the diameter of the circle formed by the grove 720 when the first ring portion 706 is secured to the second ring portion 708 matches (or is greater than) that of the filler cap 722. Since the diameter of the circle formed by the grove 720 (and the corresponding diameter of the filler cap 722) is greater than the captive ring 714, the filler cap 722 is held captive within the grove 720 when the first ring portion 706 is secured to the second ring portion 708.

Figure 16:
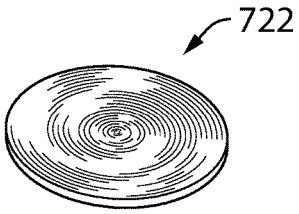
FIG. 16 shows a filler cap according to an exemplary embodiment.
Figure 17:
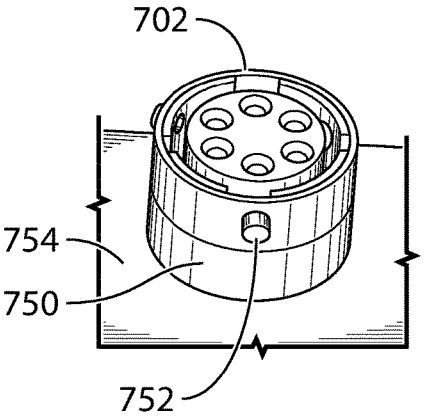
FIG. 17 illustrates an example unconnected connector according to the prior art.
Figure 18:
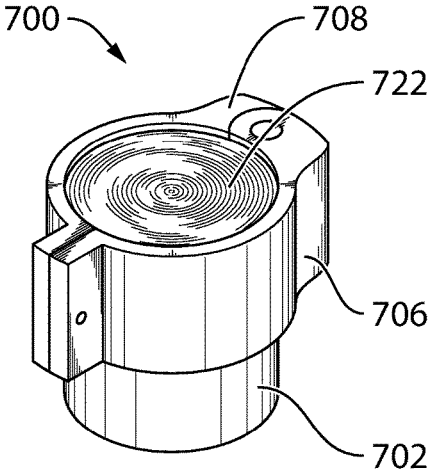
FIG. 18 illustrates the lockout device of FIG. 15 with filler plate installed while secured around the unconnected connector of FIG. 17.

FIGS. 17 and 18 illustrated a method of utilizing the lockout device 700 and filler cap 722 of FIGS. 15 and 16. The steps of the below method are not restricted to the exact order described, and, in other configurations, described steps may be omitted or other intermediate steps added.

To begin the securing process, the user first locates an unconnected connector 702 that needs to be secured. FIG. 17 illustrates an example unconnected connector 702 according to the prior art.

After locating the connector 702 to be secured, a lockout device 700 and associated filler cap 722 are selected for the type and size of the connector 702. The set screw 704 of the lockout device 700 is unscrewed in order to spread open the first and second ring portions 706, 708 and wrap the tubular ring formed by the lockout device 700 around the unconnected connector 702. During this step, the user should orientate the lockout device 700 such that the inner protruding locator ring 712 extends into the gap 750 formed between the connector mounting posts 752 and the panel base 754. When orientated in the correct manner, the grove 720 within the captive ring 714 for holding the filler plate 722 will be above the unconnected connector 702.

The user then inserts the filler ring 722 into the grove 720 and closes the first and second ring portions 706, 708 around both the unconnected connector 702 and the filler plate 722. Again, closing the lockout device 700 involves rotating the first and second ring portions 706, 708 towards one another and securing the set screw 704.

FIG. 18 illustrates the lockout device 700 of FIG. 15 with filler plate 722 installed while secured around the unconnected connector 702 of FIG. 17. The locator ring 712 on the lockout device 700 is stuck between the mounting posts 752 and the panel base 754. In this way, even though the lockout connector 700 may be wiggled and rotated around the unconnected connector 702 by a user, it is not possible to remove the lockout device 700 from the unconnected connector 702. Likewise, the filler plate 722 effectively prevents anything from coming in contact with the electrical pins of the connector, which might cause an arc by shorting out exposed pins. In order to connect a cable to the connector 702, the user must utilize a secondary tool such as a screw driver or Allen key in order to release the set screw 704 and remove the lockout device 700 form the connector 702.

Different sizes and shapes of the filler plate 722 may be utilized as required. For instance, a square filler plate may be utilized in conjunction with the square lockout device 600 of FIG. 14.

Although the above usage example has focused on securing an unconnected connector 702 on a panel side, a similar process may also be utilized to secure an unconnected connector on the cable side. In that alternate usage, the lockout device 700 may be positioned similar to as previously described in the example of FIG. 11 by ensuring that the inner protruding locator ring 712 extends into the gap 412 formed between the locking ring 414 of the cable connector 410 and the connector backshell 416.

Likewise, although the above exemplary embodiment and usage example included the use of a separate filler plate 722, the separate filler plate 722 may be omitted in other embodiments. For instance, rather than a separate filler plate 722, the lockout device 700 may be modified such that the filler plate 722 is integrated with one or both of the first and second ring portions 706, 708. In some embodiments, the end of the lockout device 700 away from the locator ring 712 may be closed when the first and second ring portions 706, 708 are secured together to prevent connecting a cable to the connector.

Unused connectors 702 may also be secured in other applications by simply attaching a lockout device 300, 500, 600, 700 without any filler cap 722 or closed end. Although the connector pins will still be accessible through the open ended tubular ring of the lockout device 300, 500, 600, 700, the lockout device 300, 500, 600, 700 may still prevent the user from physically attaching and/or securing anything to the unused connector due to physical interference caused by the lockout device 300, 500, 600, 700. Since the lockout device 300, 500, 600, 700 cannot be removed without a secondary tool, the goal of preventing cable connection and/or disconnection without the use of a secondary tool may still be achieved in some applications without a filler plate 722 or closed end.

Figure 19:
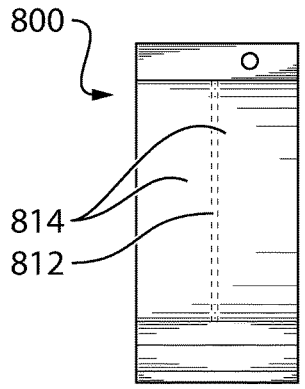
FIG. 19 shows a side view assembly diagram of a lockout device with extended captive ring according to an exemplary embodiment.

FIG. 19 shows a side view assembly diagram of a lockout device 800 with extended captive ring 814 according to an exemplary embodiment. In this embodiment, rather than the locator ring 812 being flush with an edge of the first and second ring portions 806, 808, the inner facing locator ring

812 is in the middle of a two-sided captive ring 814 that extends lengthwise on both sides of the locator ring 812.

Figure 20:
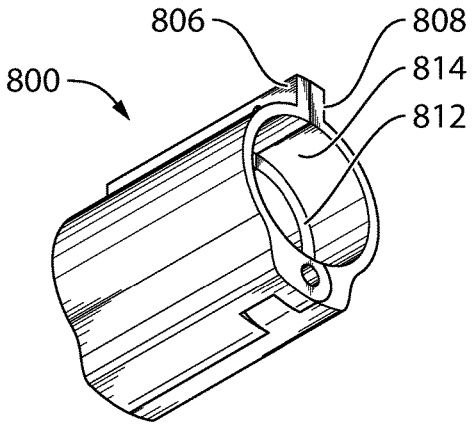
FIG. 20 shows an isometric view assembly diagram of the lockout device of FIG. 19.

FIG. 20 shows an isometric view assembly diagram of the lockout device 800 of FIG. 19. As shown, the length of the tubular ring formed by the first and second ring portions 806, 808 is extended in comparison with that shown in FIG. 6. The locator ring 814 can be seen in the middle of the tubular ring. In other embodiments, the locator ring 814 may be offset from the middle and may be positioned at any desired location within the tubular ring. A benefit of the embodiment of FIGS. 19 and 20 is that the two-sided captive ring 814 can cover portions of the connector on both sides of the locator ring 812.

Figure 21:
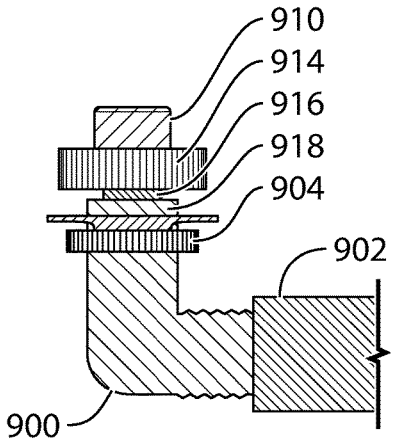
FIG. 21 illustrates a side view of two connectors attached to one another according to the prior art.

FIG. 21 illustrates a side view of two connectors 900, 910 attached to one another according to the prior art. In this example, the first connector 900 consists of an ninety-degree angled connector attached to the end of a cable 902. The second connector 910 consists of a circular connector attached to the ninety-degree angled connector 900. As both the first connector 900 and the second connector 910 have respective locking rings 904, 914, there are two ways for a user to disconnect the connection to cable 902.

Figure 22:
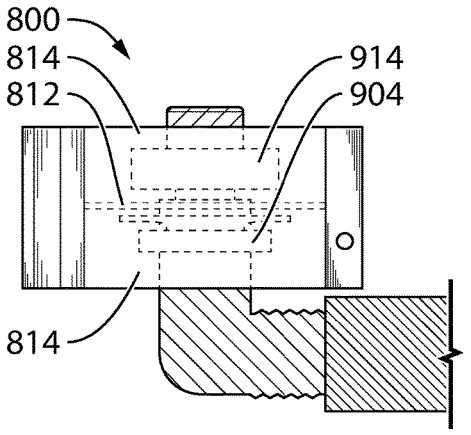
FIG. 22 illustrates a side view of the two connectors of FIG. 21 with the lockout device of FIG. 19 secured therearound.

FIG. 22 illustrates a side view of the two connectors 900, 910 of FIG. 21 with the lockout device 800 of FIG. 19 secured around the two connectors. As illustrated, the locator ring 912 is secured in the gap 914 between the locking ring 914 and the backshell 918 of the second connector 910. In this way, the lockout device 800 is held captive over the second connector 910.

The first side of the dual captive ring 806 extends downwards to fully cover the locking ring 904 of the first connector 900. In this way, the user may not access the locking ring of the first connector. Likewise, the other side of the dual captive ring 806 extends upwards to fully cover the locking ring 914 of the second connector 910. In this way, the user may not access the locking ring 914 of the second connector 910. Advantageously, both the first and second connectors 900, 910 are simultaneously secured from disconnection using a single lockout device 800.

Figure 23:
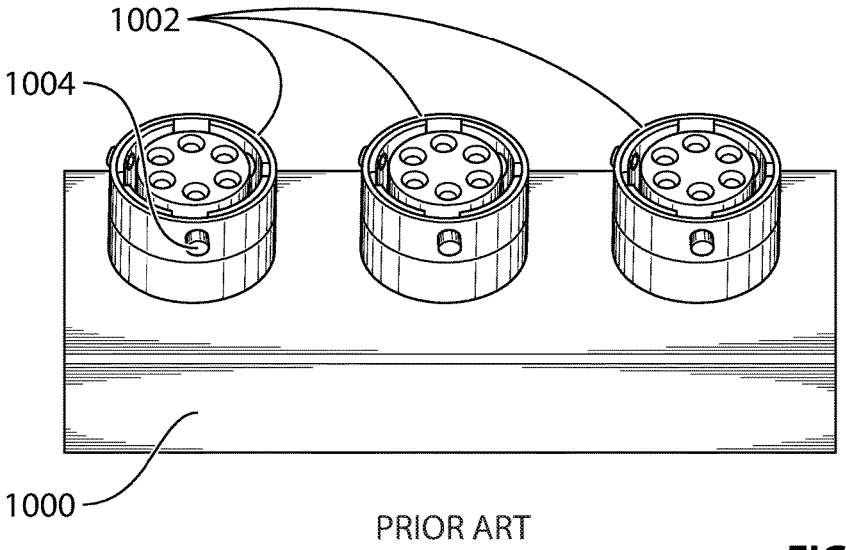
FIG. 23 illustrates a prior art panel having multiple connectors in a row.

FIG. 23 illustrates a prior art panel 1000 having multiple connectors 1002 in a row. It may be desirable in some applications to simultaneously secure multiple connectors of a single panel 1000 using a single lockout device.

Figure 24:
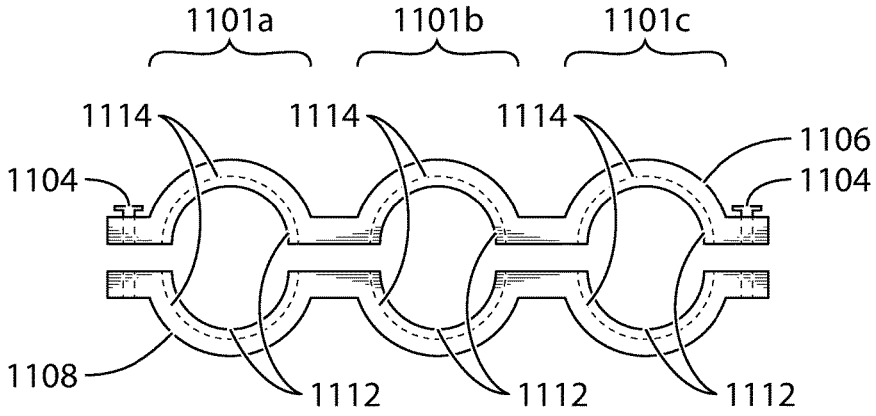
FIG. 24 illustrates a multiblock lockout device that includes a plurality of three tubular rings for securing a corresponding plurality of three connectors.

FIG. 24 illustrates a multiblock lockout device 1100 that includes a plurality of three tubular rings 1101*a*, 1101*b*, 1101*c* for securing a corresponding plurality of three connectors. Again, the lockout device 1100 is formed by a first portion 1106 and second portion 1108 that are clamped together with a plurality of set screws 1104. When secured together, the first portion 1106 and the second portion 1108 form three tubular rings 1101*a*, 1101*b*, 1101*c*, and each of the rings 1101*a*, 1101*b*, 1101*c* has a respective locator ring 1112 and captive ring 1114. As before, the locator rings 1112 are positioned during installation of the multiblock lockout device 1100 on a panel of connectors 1002 such that each of the locator rings 1112 extends into a corresponding gap on one of the connectors 1002. The locator rings 1112 thereby hold the multiblock lockout device 1100 captive on the connectors 1102. In addition to being unconnected panel connectors 1102 such as illustrated in FIG. 23, the multiblock lockout device 110 may also be secured onto a plurality of connected panel connectors attached to a plurality of cables.

When all connectors 1002 on the panel are disconnected such as illustrated in FIG. 23, the multiblock lockout device 1100 may be orientated such that the locator rings 1112 are between the mounting posts 1004 of the connectors 1002 and the panel base 1000. Filler caps 722 similar to as shown in FIG. 16 may be installed in corresponding groves (not shown) etched around the captive ring 1114 in order to cover the unused connector pins for additional safety.

When at least one of the connectors 1002 on the panel 1000 is connected to a cable, the multiblock lockout device 1100 may be orientated such that a locator ring 1112 is positioned around the connected connector and extends into the gap 412 between the locking ring 414 on the connector and the backshell 416 of the connector. Filler caps 722 similar to as shown in FIG. 16 but with a diameter less than the captive shell 1114 but greater than the diameter of the locator ring 1112 may be positioned on top of any unconnected connectors 1002 if desired. These filler caps 722 will be held captive because their diameter is greater than the locator ring 1112.

Although the multiblock lockout device 1100 of FIG. 11 includes three tubular rings of the same size, any number of tubular rings and sizes may be included in a single multiblock lockout device 1100 in other embodiments. Different numbers and sizes may be included together on a single multiblock lockout device 1100 and these characteristics along with the relative positions of the various tubular rings may be custom made for a particular electrical panel or existing cable configuration.

Figure 25:
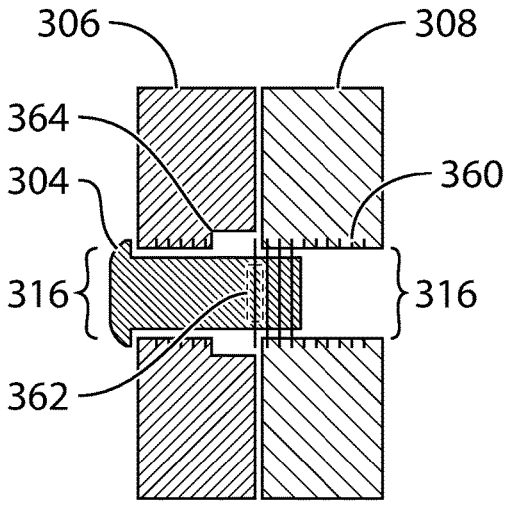
FIG. 25 illustrates a section of the lockout device of FIG. 3 taking along the line A-A according to an exemplary embodiment.

FIG. 25 illustrates a section of the lockout device 300 of FIG. 3 taking along the line A-A according to an exemplary embodiment. In this embodiment, the screw hole 316 of the first ring portion 306 has a tapered head area 364 on the side that meets the second ring portion 308. Additionally, the set screw 304 is only threaded at the far end. During manufacture, the set screw 304 is fully inserted into the first ring portion 306 such that the threads at the end of the set screw are fully within the tapered head area 364. The thread 362 on the set screw 304 closest to the head of the set screw 304 is then peened such that it will not longer run back through the threads on the first ring portion 306. In this way, the set screw 306 is held captive within the screw hole 362 and cannot be removed from the first ring portion 306.

During regular usage for locking a connector, the end user simply needs to use the secondary tool such as screwdriver or Allen key in order to turn the set screw 304 for engagement with the threads of the screw hole 316 on the second ring portion 308. The peened thread 362 is back far enough that even when the set screw 304 is fully inserted into the second ring portion 308 as far as it will go, the peened thread 362 is still not attempting to engage with any of the threads of the screw hole 316 on the second ring portion 308. In this way, the set screw 316 can still be utilized to secure the first ring portion 306 to the second ring portion 308. The thread 362 on the set screw 304 is peened at a position intermediate the first ring portion 306 and the second ring portion 308 such that the set screw 304 cannot be removed from both the first ring portion 306 and the second ring portion 308. This design prevents loss of the set screw 304 and facilitates installation and removal of the lockout device 300 around a connector 410 without needing to worry about the user dropping and loosing the set screw 304. In other embodiments, this feature is not utilized and the set screw 304 may be removable from the screw hole 316.

According to an exemplary embodiment, a lockout device includes a first ring portion positioned around a first side of a connector. A second ring portion is positioned around a second side of the connector. A fastener allows a user to selectively secure the ring portions thereby forming a tubular ring surrounding the connector. An inner facing protrusion extends toward a center of the tubular ring and into a gap present on the connector. The inner facing protrusion remains in the gap of the connector regardless of movement of the lockout device about the connector while the first ring portion is secured to the second ring portion. The inner facing protrusion holds the lockout device captive around the connector and the tubular ring covers a disconnection mechanism of the connector. A secondary tool is required in order to detach the first ring portion from the second ring portion for accessing the disconnection mechanism of the connector.

Although the invention has been described in connection with preferred embodiments, it should be understood that various modifications, additions and alterations may be made to the invention by one skilled in the art without departing from the spirit and scope of the invention. For example, although the above-description has focused preventing electrical connectors from being connected and/or disconnected in order to prevent explosions in environments having flammable gases or other ignitable substances suspended in the air, the disclosed lockout devices may also be useful in other environments and with other types of connectors.

The above-described lockout devices may be manufactured in a plurality of different shapes and sizes to accommodate different types of connectors. Additionally, although set screws with a head operated by a secondary tool such as a screw driver or Allen key are described in the above examples, any desired type of fastener operated in conjunction with a secondary tool may be utilized in a similar manner other embodiments. Likewise, any type of hinge assembly may be utilized. For example, in other embodiments, the first and second ring portions 306, 308 may be designed to form a hinge joint with each at one end without the use of a hinge pin 310. Any of the above-illustrated lockout devices that are not hinged may be hinged in other embodiments; likewise, any of the above illustrated hinged embodiments may be converted to be hingeless (e.g., by utilizing multiple set screws instead of a hinge assembly).

In addition to set screws and hinge assemblies, other means for securing the first ring portion 306 to the second ring portion 308 in different embodiments include any suitable fastener such as bolts and/or nuts, locks, snaps, etc. Examples of secondary tools that may be required to open and close the lockout device in different embodiments includes screw drivers, socket wrenches, ratchets, Allen keys, lock keys, etc.

In another exemplary modification, the locator ring 312 may be implemented as a partial ring or a series of inner facing protrusions instead of a continuous ridge. As long as the locator ring 312 will abut against an edge or other gap on the connector while the first ring portion 306 is secured to the second ring portion 308, the locator ring 312 will prevent the lockout device from sliding in that direction. Multiple locator rings 312 may be included on single lockout device 300 and abut against respective edges of the connector (or backshell or panel base) in different directions.

Single parts illustrated herein may be separated into multiple parts, and/or multiple parts may be combined into a single unit in other embodiments. All combinations and permutations of the above described features and embodiments may be utilized in conjunction with the invention.

What is claimed is:

1. A lockout device for securing a connector, the lockout device comprising:

a first ring portion for positioning around a first side of the connector;

a second ring portion for positioning around a second side of the connector;

a fastener allowing a user to selectively secure the first ring portion to the second ring portion thereby forming a tubular ring surrounding the connector; and an inner facing protrusion on at least one of the first ring portion and the second ring portion that extends toward a center line of the tubular ring and into a gap present on the connector;

wherein the inner facing protrusion is of sufficient length such that at least a portion of the inner facing protrusion remains in the gap of the connector regardless of movement of the lockout device about the connector while the first ring portion is secured to the second ring portion, the inner facing protrusion thereby holding the lockout device captive around the connector such that the connector cannot be slid out of the tubular ring while the first ring portion is secured to the second ring portion;

the tubular ring covers a disconnection mechanism of the connector such that the disconnection mechanism of the connector is inaccessible to the user while the lockout device is held captive on the connector;

the fastener requires the user to utilize a secondary tool in order to detach the first ring portion from the second ring portion for accessing the disconnection mechanism of the connector the inner facing protrusion comprises a ridge on an inner facing side of both the first ring portion and the second ring portion;

the ridge forms a locator ring that positions and holds the lockout device captive on the connector while the first ring portion is secured to the second ring portion;

the disconnection mechanism of the connector is a locking ring;

the first ring portion and the second ring portion together enclose the locking ring such that the locking ring is inaccessible to the user while the first ring portion is secured to the second ring portion; and the lockout device further comprises a filler plate covering electrical pins of the connector.

2. The lockout device of claim 1, wherein the locator ring extends into the gap on the connector adjacent a back shell of the connector.

3. The lockout device of claim 1, wherein the fastener is selected from the group comprising a set screw and a hinge.

4. The lockout device of claim 1, wherein a thread on the fastener is peened at a position intermediate the first ring portion and the second ring portion such that the fastener cannot be removed from both the first ring portion and the second ring portion.

5. The lockout device of claim 1, further comprising a plurality of fasters securing the first ring portion to the second ring portion.

6. The lockout device of claim 1, wherein:

the first ring portion attaches to the second ring portion in part utilizing a hinge pin permanently installed through a hinge assembly on the first ring portion and the second ring portion; and the first ring portion and the second ring portion are rotatable around the hinge pin such that in an open position the lockout device can be placed around the connector by the user, and in a closed position the lockout device is held captive around the connector.

7. The lockout device of claim 1, wherein the first clamp and second ring portion are C-shaped.

8. The lockout device of claim 1, wherein the first ring portion and the second ring portion together further enclose a second disconnection mechanism of an angled connector attached to the connector such that the second disconnection mechanism is also inaccessible to the user while the lockout device is held captive on the connector.

9. The lockout device of claim 1, wherein the filler plate is formed by the first ring portion and the second ring portion together having closed ends such that the connector is capped and also inaccessible to the user while the lockout device is held captive on the connector.

10. The lockout device of claim 1, wherein the filler plate is inserted by the user between the first ring portion and the second ring portion prior to securing the first ring portion to the second ring portion; the filler plate acting as a cap such that the connector is also inaccessible to the user while the lockout device is held captive on the connector.

11. The lockout device of claim 1, wherein:

while the first shell clamp and the second shell clamp are secured together, they form a plurality of tubular rings for enclosing a plurality of connectors; and the first ring portion and the second ring portion further enclose respective disconnection mechanisms of the plurality of connectors such that each of the disconnection mechanisms is inaccessible to the user while the lockout device is held captive on the plurality of connectors.

12. The lockout device of claim 1, wherein the filler plate is integrated with at least one of the first ring portion and the second ring portion.

13. The lockout device of claim 1, wherein the filler plate is a separate part from the first ring portion and the second ring portion.

14. A method of securing a connector, the method comprising:

positioning a first ring portion around a first side of the connector;

positioning a second ring portion around a second side of the connector;

utilizing a fastener to selectively secure the first ring portion to the second ring portion thereby forming a lockout device with a tubular ring shape surrounding the connector; and ensuring an inner facing protrusion on at least one of the first ring portion and the second ring portion extends toward a center line of the tubular ring and into a gap present on the connector;

wherein the inner facing protrusion is of sufficient length such that at least a portion of the inner facing protrusion remains in the gap of the connector regardless of movement of the lockout device about the connector while the first ring portion is secured to the second ring portion, the inner facing protrusion thereby holding the lockout device captive around the connector such that the connector cannot be slid out of the tubular ring while the first ring portion is secured to the second ring portion;

the tubular ring covers a disconnection mechanism of the connector such that the disconnection mechanism of the connector is inaccessible to a user while the lockout device is held captive on the connector;

the fastener requires the user to utilize a secondary tool in order to detach the first ring portion from the second ring portion for accessing the disconnection mechanism of the connector;

the inner facing protrusion comprises a ridge on an inner facing side of both the first ring portion and the second ring portion;

the ridge forms a locator ring that positions and holds the lockout device captive on the connector while the first ring portion is secured to the second ring portion;

the disconnection mechanism of the connector is a locking ring;

the first ring portion and the second ring portion together enclose the locking ring such that the locking ring is inaccessible to the user while the first ring portion is secured to the second ring portion; and the method further comprises providing a filler plate covering electrical pins of the connector.

15. The method of claim 14, further comprising positioning the locator ring such that it extends into the gap on the connector adjacent a back shell of the connector.

16. The method of claim 14, wherein the first ring portion and the second ring portion together further enclose a second disconnection mechanism of an angled connector attached to the connector such that the second disconnection mechanism is also inaccessible to the user while the lockout device is held captive on the connector.

17. The method of claim 14, further comprising inserting the filler plate between the first ring portion and the second ring portion prior to securing the first ring portion to the second ring portion; the filler plate acting as a cap such that the connector is also inaccessible to the user while the lockout device is held captive on the connector.

18. The method of claim 14, wherein:

while the first shell clamp and the second shell clamp are secured together, they form a plurality of tubular rings for enclosing a plurality of connectors; and the first ring portion and the second ring portion further enclose respective disconnection mechanisms of the plurality of connectors such that each of the disconnection mechanisms is inaccessible to the user while the lockout device is held captive on the plurality of connectors.

19. The method of claim 14, wherein the filler plate is formed by the first ring portion and the second ring portion together having closed ends such that the connector is capped and also inaccessible to the user while the lockout device is held captive on the connector.

20. The method of claim 14, wherein the filler plate is a separate part from the first ring portion and the second ring portion.

* * * * *